US009828998B2

(12) United States Patent
Tychsen

(10) Patent No.: US 9,828,998 B2
(45) Date of Patent: Nov. 28, 2017

(54) SCREW COMPRESSOR

(71) Applicant: Johnson Controls Technology Company, Plymouth, MI (US)

(72) Inventor: Holger Tychsen, Waynesboro, PA (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 15/289,869

(22) Filed: Oct. 10, 2016

(65) Prior Publication Data

US 2017/0022990 A1 Jan. 26, 2017

Related U.S. Application Data

(63) Continuation of application No. 14/055,429, filed on Oct. 16, 2013, now Pat. No. 9,482,230.

(60) Provisional application No. 61/714,977, filed on Oct. 17, 2012.

(51) Int. Cl.

| | |
|---|---|
| ***F01C 21/02*** | (2006.01) |
| ***F04C 18/08*** | (2006.01) |
| ***F03C 2/08*** | (2006.01) |
| ***F04C 2/08*** | (2006.01) |
| ***F01C 1/16*** | (2006.01) |
| ***F04C 27/02*** | (2006.01) |
| ***F04C 29/00*** | (2006.01) |
| ***F04C 18/16*** | (2006.01) |
| *F04B 35/04* | (2006.01) |
| *F04C 18/02* | (2006.01) |

(52) U.S. Cl.

CPC ..... *F04C 29/0085* (2013.01); *F04C 18/16* (2013.01); *F04C 29/0021* (2013.01); *F04B 35/04* (2013.01); *F04C 18/0215* (2013.01); *F04C 2240/10* (2013.01); *F04C 2240/30* (2013.01); *F04C 2240/50* (2013.01); *F04C 2240/60* (2013.01)

(58) Field of Classification Search

CPC ... F04C 29/0085; F04C 18/16; F04C 29/0021

USPC ..... 418/201.1, 201, 100, 206.7, 270, 87, 73, 418/98

See application file for complete search history.

(56) References Cited

U.S. PATENT DOCUMENTS

| | | | | |
|---|---|---|---|---|
| 2,504,230 A | | 4/1950 | Smith | |
| 4,227,755 A | * | 10/1980 | Lundberg | F01C 21/02 384/101 |
| 5,028,220 A | * | 7/1991 | Holdsworth | F04C 29/02 418/2 |

(Continued)

*Primary Examiner* — Mark Laurenzi
*Assistant Examiner* — Deming Wan
(74) *Attorney, Agent, or Firm* — Fletcher Yoder, PC

(57) ABSTRACT

A screw compressor includes a housing having an inlet for receiving gas to be compressed by the compressor and an outlet for discharging pressurized compressed gas. A pair of meshing threaded rotors, each rotor having an axis and being rotatably received in the housing, each rotor having a first end near the inlet and a second end near the outlet. A bearing rotatably carrying each rotor about its axis and positioned near the first end and the second end of each rotor. A conduit formed in the housing in selectable fluid communication with at least one bearing and a force generating source from a pressurized fluid source, the force generating source selectably providing a force in a radial direction relative to the axis of the at least one bearing.

23 Claims, 14 Drawing Sheets

(56) References Cited

U.S. PATENT DOCUMENTS

| | | | | |
|---|---|---|---|---|
| 6,612,820 | B1 * | 9/2003 | Staat | F04C 27/009 418/1 |
| 2008/0098754 | A1 * | 5/2008 | Sommer | F25B 41/00 62/115 |
| 2012/0237382 | A1 | 9/2012 | Yoshimura | |
| 2015/0140512 | A1 * | 5/2015 | Bachler | A61C 13/2656 433/201.1 |

* cited by examiner

SCREW COMPRESSOR

CROSS-REFERENCE TO RELATED APPLICATIONS

This application is a continuation of U.S. patent application Ser. No. 14/055,429, filed Oct. 16, 2013, entitled "SCREW COMPRESSOR", which claims priority from and the benefit of U.S. Provisional Patent Application No. 61/714,977, filed Oct. 17, 2012, entitled "SCREW COMPRESSOR", each of which is hereby incorporated by reference.

BACKGROUND

The application relates generally to screw compressors. The application relates more specifically to screw compressors capable of operating at increased pressures.

Heating and cooling systems typically maintain temperature control in a structure by circulating a fluid within coiled tubes such that passing another fluid over the tubes effects a transfer of thermal energy between the two fluids. A primary component in such a system is a compressor which receives a cool, low pressure gas and by virtue of a compression device, exhausts a hot, high pressure gas. One type of compressor is a screw compressor, which generally includes two cylindrical rotors mounted on separate shafts inside a hollow, double-barreled casing. The side-walls of the compressor casing typically form two parallel, overlapping cylinders which house the rotors side-by-side, with their shafts parallel to the ground. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and continuously reduces in volume as the rotors turn and compress the gas toward a discharge port at the opposite end of the casing for use in the system.

During operation, due to the difference in pressures 80, 82 between the respective inlet and outlet openings or ports, also referred to as inlet 81 and outlet 83, the resulting generated forces 86 are reacted by bearings secured in the housing (FIGS. 1 and 2) near opposed ends 90, 91 of the rotors 92, 94. One way to further increase operating pressures and differences between the inlet and outlet pressures 80, 82 is to apply larger bearings or add more bearings in parallel. However, there are significant challenges associated with increasing the forces generated by the rotors during their operation. As shown in FIG. 2, the size of the bearings, i.e., the diameter ("DM") of the bearings 88 associated with the male rotor 92 and the diameter ("DF") of the bearings 88 associated with the female rotor 94 is related to the distance ("CD") between the rotational axes 96, 98 of the respective male rotor 92 and the female rotor 94 as identified in equation 1:

$$(DM+DF)/2<CD \quad [1]$$

In other words, one half of the sum of the diameter DM of the bearings 88 associated with the male rotor 92 and the diameter DF of the bearings associated with the female rotor 94 must be less than the distance CD between the rotational axes 96, 98 of the male rotor 92 and the female rotor 94. Unfortunately, bearing load carrying capability is related to its diameter, and current designs are approaching the upper limits of bearing load carrying capability for the largest bearing sizes that may be used.

In addition, the solution cannot be achieved by adding bearings in a side-by-side 104 arrangement to each end of the rotors, for several reasons. First, as shown collectively in FIGS. 3-4, even bearings 88 having identical part numbers can have different clearances 100, as well as different interferences 102 with the rotor shaft 106. As a result, it is extremely difficult for bearings 88 positioned side-by-side 104 to each other to be parallel to each other and share in supporting the operating loads. Second, even if the bearings 88 positioned side-by-side 104 to each other are parallel, due to the deformation of the rotor 92, 94 (rotor 94 shown in FIG. 5) under load (FIG. 5 is not to scale to assist in understanding the effect of rotor deformation), the ends 90, 91 of the rotors 92, 94 would still not be parallel to the respective axis of rotation of each rotor. Therefore, under such operating conditions, it is impossible for conventional bearings 88 positioned side-by-side 104 to reliably and/or meaningfully share in supporting the operating loads. Worse yet, if the rotor 92, 94 deflection is sufficiently large, shear loads 108, due to misalignment are created for which the bearings 88 are not designed to withstand, resulting in premature failure of the bearings 88, and at the least, down time of the screw compressor, if not risk of damage of other screw compressor components.

Accordingly, there is an unmet need for reliably and inexpensively supporting increased operating loads of screw compressors.

SUMMARY

One embodiment of the present invention is directed to a screw compressor including a housing having an inlet for receiving gas to be compressed by the compressor and an outlet for discharging pressurized compressed gas. A pair of meshing threaded rotors, each rotor has an axis and being rotatably received in the housing, each rotor has a first end near the inlet and a second end near the outlet. A bearing rotatably carries each rotor about its axis and is positioned near the first end and the second end of each rotor. A conduit is formed in the housing in selectable fluid communication with at least one bearing and a force generating source, the force generating source selectably providing a force in a radial direction relative to the axis of the at least one bearing.

One embodiment of the present invention is directed to a method for providing increased pressure and pressure difference for a screw compressor. The method further includes providing a housing having an inlet for receiving a gas to be compressed by the compressor and an outlet for discharging pressurized compressed gas. A pair of meshing threaded rotors is provided, each rotor having an axis and being rotatably received in the housing, each rotor having a first end near the inlet and a second end near the outlet. A bearing rotatably carries each rotor about its axis and positioned near the first end and the second end of each rotor. A conduit is formed in the housing in fluid communication with at least one bearing for selectably providing pressurized fluid in a radial direction relative to the axis to the at least one bearing. The method further includes selectably providing pressurized fluid to the at least one bearing.

Another embodiment of the present invention is directed to a compression system including a structure configured to receive a plurality of bearings. The bearings are configured to rotatably carry a pair of shafts, each shaft having a first end, a second end, and an axis. Each shaft is rotatably received about the axis in the bearings. The pair of shafts is configured to compress matter passing between the first end and the second end of each shaft of the pair of shafts. A conduit is formed in the housing in selectable fluid communication with at least one bearing of the plurality of bearings and a pressurized fluid from a pressurized fluid source. The pressurized fluid selectably provides a force in a radial direction relative to the axis of the at least one bearing.

DETAILED DESCRIPTION OF EXEMPLARY EMBODIMENTS

Figure 6:
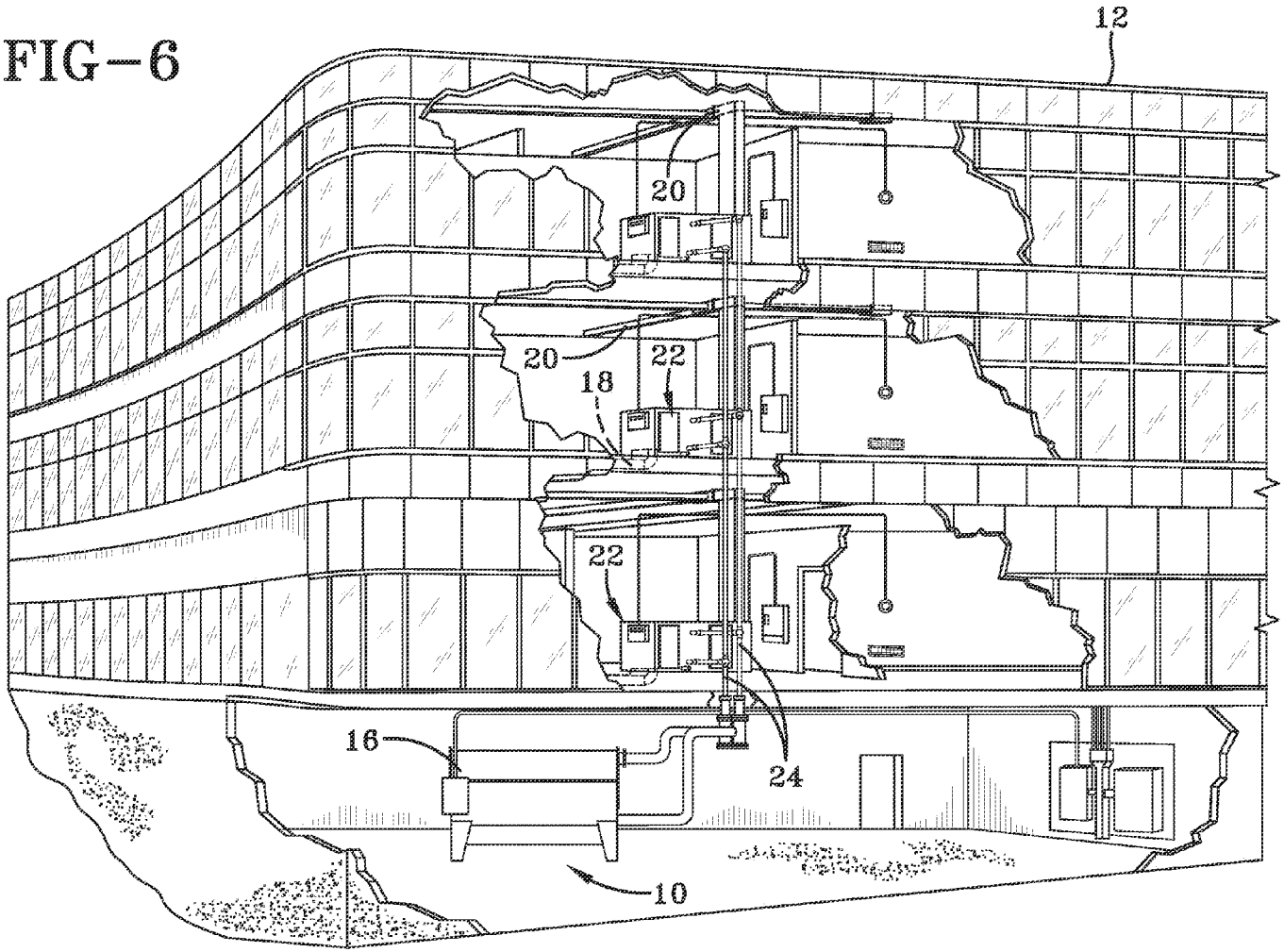
FIG. 6 shows an exemplary embodiment for a heating, ventilation and air conditioning (HVAC&R) system.

FIG. 6 shows an exemplary environment for an HVAC&R system 10 in a building 12 for a typical commercial setting. System 10 may include a compressor (not shown) incorporated into a chiller 16 that can supply a chilled liquid that may be used to cool building 12. In one embodiment, compressor 38 may be a screw compressor 38 (see for example, FIG. 7). In other embodiments compressor 38 may be a centrifugal compressor or reciprocal compressor (not shown). System 10 includes an air distribution system that circulates air through building 12. The air distribution system can include an air return duct 18, an air supply duct 20 and an air handler 22. Air handler 22 can include a heat exchanger (not shown) that is connected to a boiler (not shown) and chiller 16 by conduits 24. Air handler 22 may receive either heated liquid from the boiler or chilled liquid from chiller 16, depending on the mode of operation of HVAC&R system 10. HVAC&R system 10 is shown with a separate air handler on each floor of building 12, but it will be appreciated that these components may be shared between or among floors. In another embodiment, the system 10 may include an air-cooled chiller that employs an air-cooled coil as a condenser. An air-cooled chiller may be located on the exterior of the building—for example, adjacent to or on the roof of the building.

Figure 7:
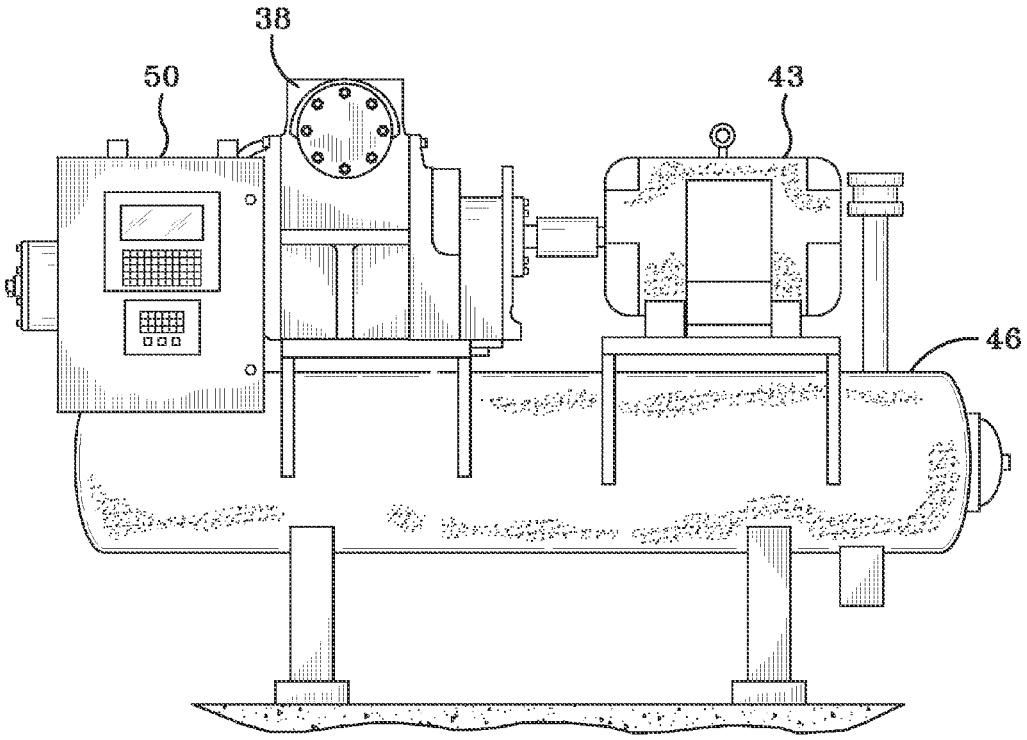
FIG. 7 shows an exemplary embodiment of a compressor unit of a heating, ventilation, air conditioning and refrigeration (HVAC&R) system.

FIG. 7 shows an exemplary embodiment of a screw compressor in a packaged unit for use with chiller 16. The packaged unit includes a screw compressor 38, a motor 43 to drive screw compressor 38, a control panel 50 to provide control instructions to equipment included in the packaged unit, such as motor 43. An oil separator 46 can be provided to remove entrained oil (used to lubricate the rotors of screw compressor 38) from the discharge vapor before providing the discharge vapor to its intended application.

Figure 8:
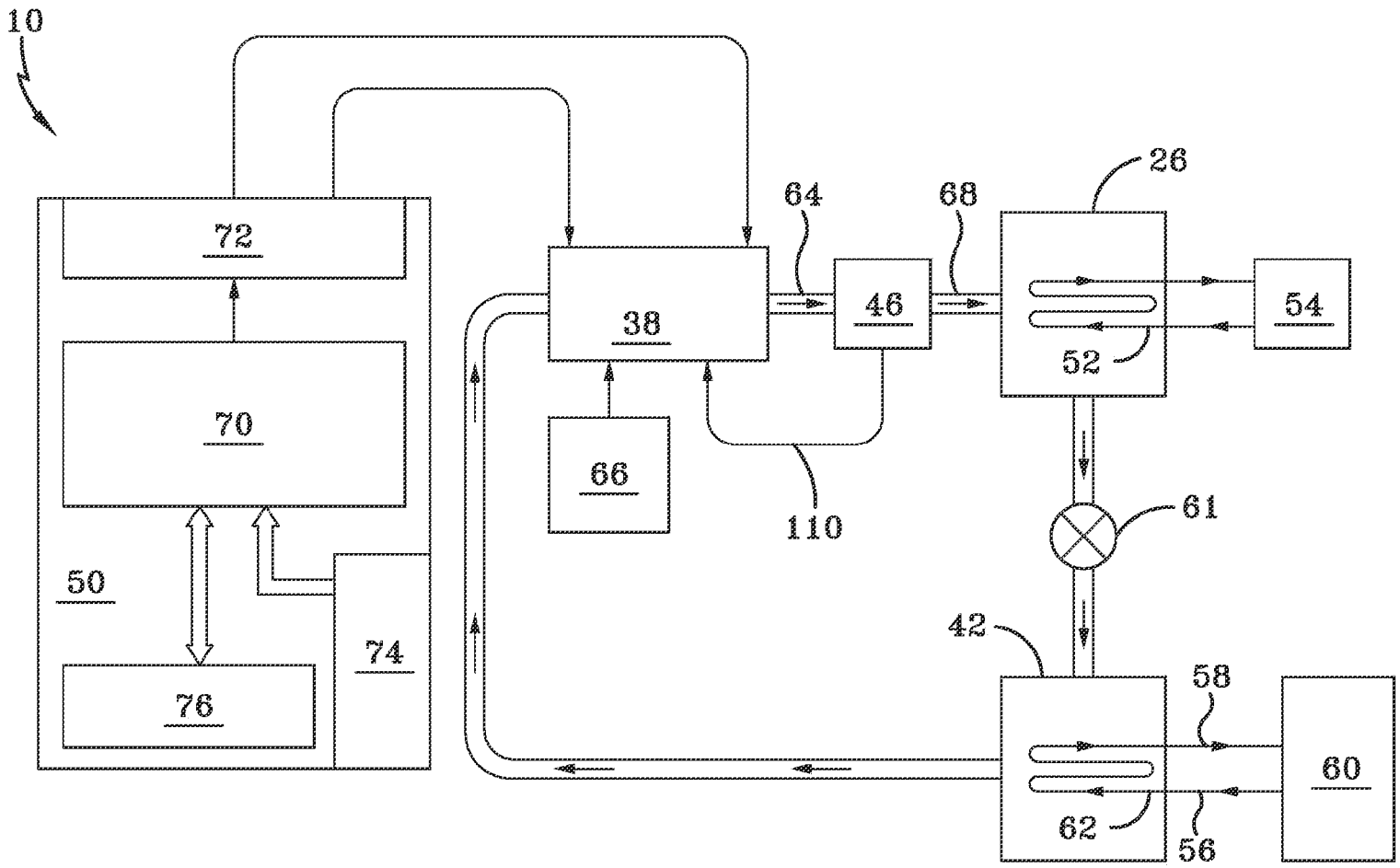
FIG. 8 schematically illustrates an exemplary embodiment of an HVAC&R system.

FIG. 8 shows an exemplary HVAC&R or liquid chiller system 10, which includes compressor 38, condenser 26, water chiller or evaporator 42, and a control panel 50. Control panel 50 may include a microprocessor 70, an interface board 72, an analog-to-digital (A to D) converter 74, and/or a non-volatile memory 76. Control panel 50 may be positioned or disposed locally and/or remotely to system 10. Control panel 50 receives input signals from system 10. For example, temperature and pressure measurements may indicate the performance of system 10. The signals may be transmitted to components of system 10, for example, a compressor capacity control signal, to control the operation of system 10. Conventional liquid chiller or HVAC&R system 10 may include other features that are not shown in FIG. 8 and have been purposely omitted to simplify the drawing for ease of illustration. While the following description of system 10 is in terms of a liquid chiller system, it is to be understood that the invention could be applied to any refrigeration system or any HVAC&R system.

Compressor 38 compresses a refrigerant vapor and delivers the vapor to condenser 26 through a discharge line 68. Compressor 38 may be any suitable type of compressor including screw compressor, reciprocating compressor, scroll compressor, rotary compressor or other type of compressor. System 10 may have more than one compressor 38 connected in one or more refrigerant circuits.

Refrigerant vapor delivered to condenser 26 enters into a heat exchange relationship with a fluid, for example, air or water, and undergoes a phase change to a refrigerant liquid as a result of the heat exchange relationship with the fluid. The condensed liquid refrigerant from condenser 26 flows to evaporator 42. Refrigerant vapor in condenser 26 enters into the heat exchange relationship with water, flowing through a heat exchanger coil 52 connected to a cooling tower 54. Alternatively, the refrigerant vapor is condensed in a coil with heat exchange relationship with air blowing across the coil. The refrigerant vapor in condenser 26 undergoes a phase change to a refrigerant liquid as a result of the heat exchange relationship with the water or air in heat exchanger coil 52.

Evaporator 42 may include a heat exchanger coil 62 having a supply line 56 and a return line 58 connected to a cooling load 60. Heat exchanger coil 62 can include a plurality of tube bundles within evaporator 42. A secondary liquid, for example, water, ethylene, calcium chloride brine, sodium chloride brine, or any other suitable secondary liquid travels into evaporator 42 via return line 58 and exits evaporator 42 via supply line 56. The liquid refrigerant in evaporator 42 enters into a heat exchange relationship with the secondary liquid in heat exchanger coil 62 to chill the temperature of the secondary liquid in heat exchanger coil 62. The refrigerant liquid in evaporator 42 undergoes a phase change to a refrigerant vapor as a result of the heat exchange relationship with the secondary liquid in heat exchanger coil 62. The vapor refrigerant in evaporator 42 exits evaporator 42 and returns to compressor 38 by a suction line to complete the cycle. While system 10 has been described in terms of condenser 26 and evaporator 42, any suitable configuration of condenser 26 and evaporator 42 can be used in system 10, provided that the appropriate phase change of the refrigerant in condenser 26 and evaporator 42 is obtained.

In one embodiment, chiller system capacity may be controlled by adjusting the speed of a compressor motor driving compressor 38, using a variable speed drive (VSD).

It is appreciated that HVAC&R systems can also include conventional heat pumps, which are not further discussed herein.

To drive compressor 38, system 10 includes a motor or drive mechanism 66 for compressor 38. While the term "motor" is used with respect to the drive mechanism for compressor 38, the term "motor" is not limited to a motor, but may encompass any component that may be used in conjunction with the driving of compressor 38, such as a variable speed drive and a motor starter. Motor or drive mechanism 66 may be an electric motor and associated components. Other drive mechanisms, such as steam or gas turbines or engines and associated components may be used to drive compressor 38.

The control panel executes a control system that uses a control algorithm or multiple control algorithms or software to control operation of system 10 and to determine and implement an operating configuration for the inverters of a VSD (not shown) to control the capacity of compressor 38 or multiple compressors in response to a particular output capacity requirement for system 10. The control algorithm or multiple control algorithms may be computer programs or software stored in non-volatile memory 76 of control panel 50 and may include a series of instructions executable by microprocessor 70. The control algorithm may be embodied in a computer program or multiple computer programs and may be executed by microprocessor 70, the control algorithm may be implemented and executed using digital and/or analog hardware (not shown). If hardware is used to execute the control algorithm, the corresponding configuration of control panel 50 may be changed to incorporate the necessary components and to remove any components that may no longer be required.

Chiller system 10, as illustrated in FIG. 8, includes compressor 38 in fluid communication with an oil separator 46. An oil and refrigerant gas mixture travels along discharge pipe 64 from compressor 38 to oil separator 46. Compressor 38 is in fluid communication with oil separator 46 via oil return line 110. Condenser 26 is provided in fluid communication with oil separator 46, and refrigerant gas travels from oil separator 46 to condenser 26. At condenser 26, refrigerant gas is cooled and condensed into a refrigerant liquid, which is in turn transmitted to evaporator 42 through expansion valve 61. At evaporator 42, heat transfer takes place between the refrigerant liquid and a second fluid that is cooled to provide desired refrigeration. The refrigerant liquid in evaporator 42 is converted into a refrigerant gas by absorbing heat from the chilled liquid and returns to compressor 38. This refrigeration cycle continues when the chiller system is in operation.

Figure 9:
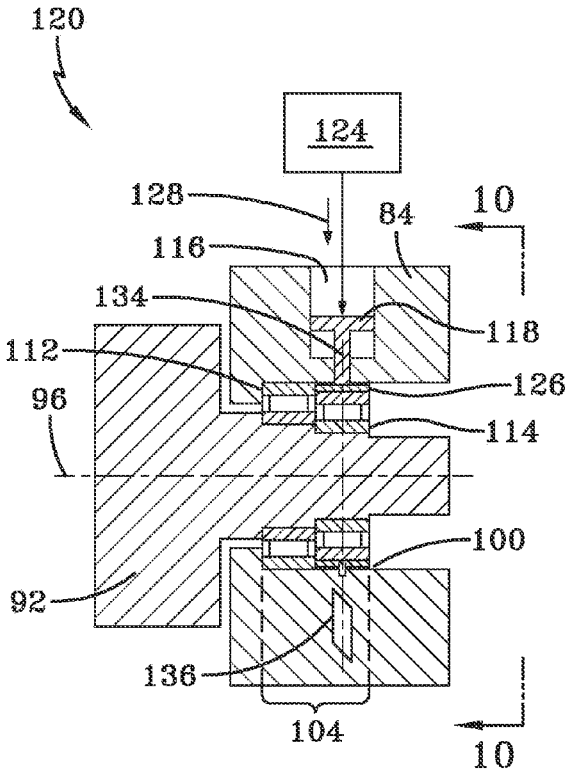
FIG. 9 shows an enlarged partial side view of a screw compressor with an exemplary side-by-side bearing arrangement.
Figure 10:
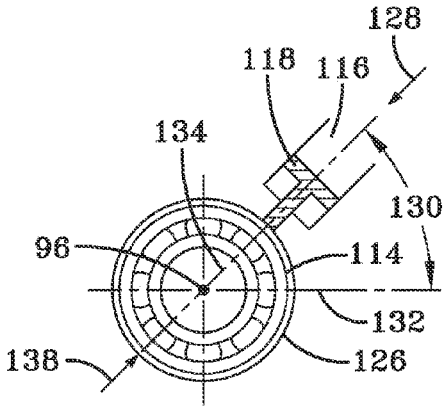
FIG. 10 shows a cross-section taken along line 10-10 of FIG. 9 of an exemplary bearing arrangement.
Figure 11:
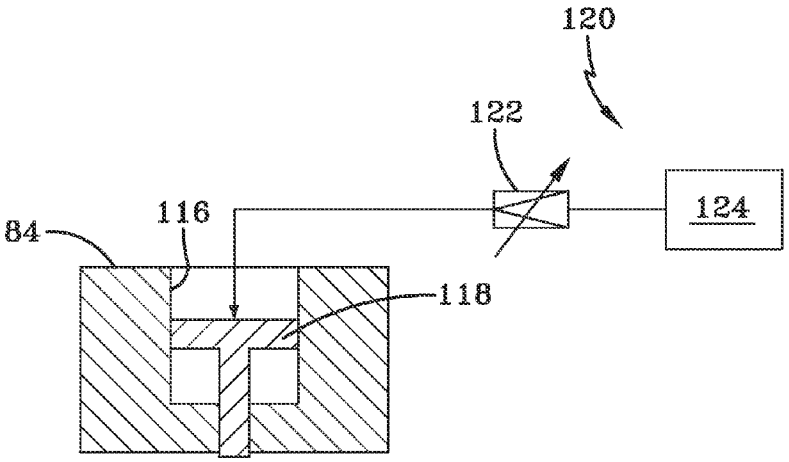
FIG. 11 shows an enlarged partial side view of an exemplary screw compressor housing taken from region 11 of FIG. 9 an exemplary embodiment.
Figure 15:
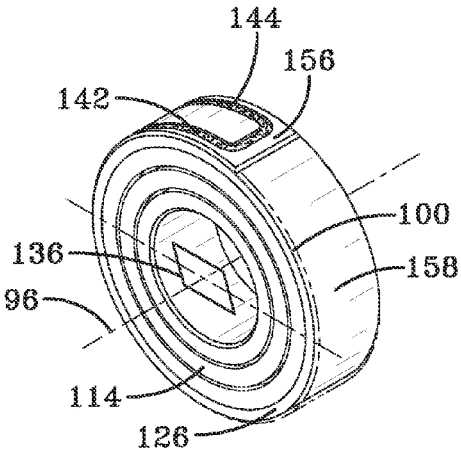
FIG. 15 shows an upper perspective of an exemplary bearing.
Figure 21:
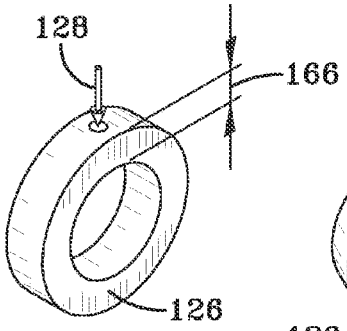
FIG. 21 shows an upper perspective view of an exe bearing race support subjected to a localized loading arrangement.
Figure 22:
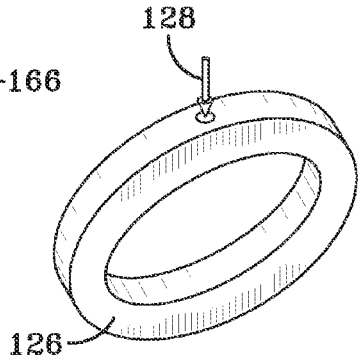
FIG. 22 shows an upper perspective view of an exemplary bearing race support subjected to a localized loading arrangement.
Figure 23:
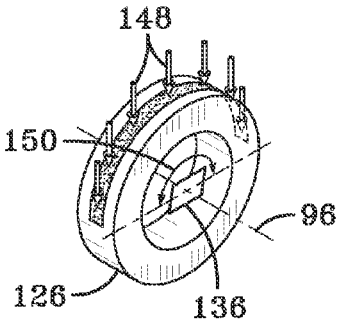
FIG. 23 shows an upper perspective view of an exemplary bearing race support subjected to a distributed loading arrangement.

FIGS. 9-11 collectively show an exemplary embodiment of a portion of a screw compressor having a side-by-side 104 bearing arrangement (a first bearing 112 and a second bearing 114 as shown in FIG. 9; previously generically identified as bearing 88) of the present disclosure. Screw compressor housing 84 includes a conduit 116 formed in housing 84 within which a piston 118 is selectably movable, such as by a force generating source 120, such as an adjustable valve 122 by pressurized gas or oil from a pressurized fluid source 124. In one embodiment, in which pressurized fluid source 124 is not provided by the gas flowing through the compressor or oil used in the compressor, the seal between piston 118 and housing 84 should generally be fluid tight. In another embodiment, in which pressurized fluid source 124 is provided by the gas flowing through the compressor or oil used in the compressor, the seal between piston 118 and housing 84 can be substantially fluid tight. That is, under such circumstances, a small amount of pressurized fluid leakage between the piston and housing would be permissible, so long as a sufficient pressure level can be maintained for proper operation of the bearings. In one embodiment, force generating source 120 includes pressurized fluid source 124 with or without a valve or other regulating component. In response to piston 118 being moved sufficiently along conduit 116, piston 118 abuts second bearing 114, which includes a bushing 126 surrounding second bearing 114. Bushing 126 is press fit onto second bearing 114. Cylindrical bushing 126 has an increased thickness (FIG. 21) that maintains the shape of bushing 126 despite being subjected to a piston force 128. In other words, cylindrical bushing 126 is of sufficient thickness to resist "flattening", such as shown in FIG. 22 in response to piston force 128. As further shown in FIGS. 9-10, piston force 128 is directed toward rotor axis 96 in a radial direction, such as designated by a subtended angle 130 from a reference axis 132 (FIG. 10). It is appreciated that the radial direction could be in any direction that opposes the gas force. That is, piston axis 134 is substantially coincident with rotor axis 96 and additionally substantially coincident with a plane 136 that is transverse or perpendicular to rotor axis 96 (FIGS. 9, 15 and 23). As further shown in FIG. 10, piston axis 134 is aligned with and opposed to the direction of gas force 138 generated during operation of the screw compressor.

It is to be understood that in one embodiment, three (3) or more bearings can be arranged in close proximity to each other, such as a side-by-side-by-side arrangement, operating to share operating loads as previously discussed.

In an exemplary embodiment, the bearings 88, 112, 114 are anti-friction bearings, such as bearings with rolling elements. In one embodiment, the rolling elements are ball bearings. Anti-friction bearings have many advantages over sleeve bearings, e.g., reduced friction losses, fewer requirements relating to oil viscosity, and reduced clearance (permitting improved rotor position control). That is, anti-friction bearings operate more efficiently than sleeve bearings, previously subject to bearing load carrying capacity limitations of a single bearing at each end of the rotors. The present disclosure permits a side-by-side bearing arrangement with consistent, load sharing capabilities, which was not previously possible, and significantly increases the load carrying capacity of the rotors. Additionally, by permitting such load sharing, the service life may be increased, as well as a time duration for purposes of maintenance.

As further shown in FIG. 9, the outer diameter of bushing 126 is configured with a predetermined spacing or clearance 100 relative to the inner diameter of housing 84 such that bushing 126, as well as second bearing 114, which is press fit into bushing 126, is permitted to "float" within the housing as a result of diametrical clearances. Clearance 100 is of sufficient magnitude such that under a condition in which it is desirable for second bearing 114 to react or counteract at least a portion of the generated rotor forces, such as generated by gas force 138 (FIG. 10), a predetermined piston force 128 applied against bushing 126 along piston axis 134 results in a corresponding movement of the collective bushing 126 and second bearing 114 relative to the inner diameter of housing 84 along plane 136 (FIG. 9), which is transverse to axis 96 of rotor 92, such movement resulting in the desired reactive or counteracting forces applied to second bearing 114.

As shown collectively in FIGS. 12-15, an exemplary embodiment of the bearing arrangement, such as side-by-side 104 positioned first bearing 112 and second bearing 114 includes a resilient material 142, such as an O-ring that is configured to be received by surface features 144, such as a groove or channel formed in the second bearing 114 and forming a substantially fluid tight seal between housing 84, conduit 116 and bushing 126 of second bearing 114. In one embodiment, in which pressurized fluid source 124 is not provided by the gas flowing through the compressor or oil used in the compressor, the seal between piston 118 and housing 84 should generally be fluid tight. In another embodiment, in which pressurized fluid source 124 is provided by the gas flowing through the compressor or oil used in the compressor, the seal between piston 118 and housing 84 can be substantially fluid tight. That is, under such circumstances, a small amount of pressurized fluid leakage between the piston and housing would be permissible, so long as a sufficient pressure level can be maintained for proper operation of the bearings. As further shown in FIG. 15, surface features 144 are formed in a bushing 126 that at least partially surrounds second bearing 114. As shown in FIGS. 12-15, pressurized gas or oil from force generating source 120 contained in conduit 116 formed in housing 84 results in the application of a distributed load or distributed force 148 to bushing 126 in a direction that is opposite that of gas force 146 generated during operation of the rotors of the screw compressor. As shown in FIG. 23, application of distributed force 148 (as defined by the resilient layer or O-ring) applied to cylindrically shaped bushing 126, subtends an angle 150 of up to 180 degrees as measured along a plane transverse to the rotor axis. As a result of the fluid pressure derived distributed force 148 being limited to 180 degrees, such distributed force 148 will not result in deformation of bushing 126, permitting use of a bushing having a reduced thickness. Without distributed force 148, (FIG. 23) such as a localized piston force 128, as shown in FIGS. 21-22, an increased thickness 166 of bushing 126 is required to prevent bushing 126 from "flattening" into an ovular profile (FIG. 22). In one embodiment, the thickness of the bushing can vary, so long as the bushing is positioned to react or carry operating loads without distortion. In order to prevent rotation of bushing 126 relative to housing 84, which may occur in response to minimum loading or operating conditions, a retainer or anti-rotation device 152 such as a pin or a compression spring (not shown) configured to apply an axial force to the bushing substantially parallel to gas force 146 may be utilized.

Figure 12:
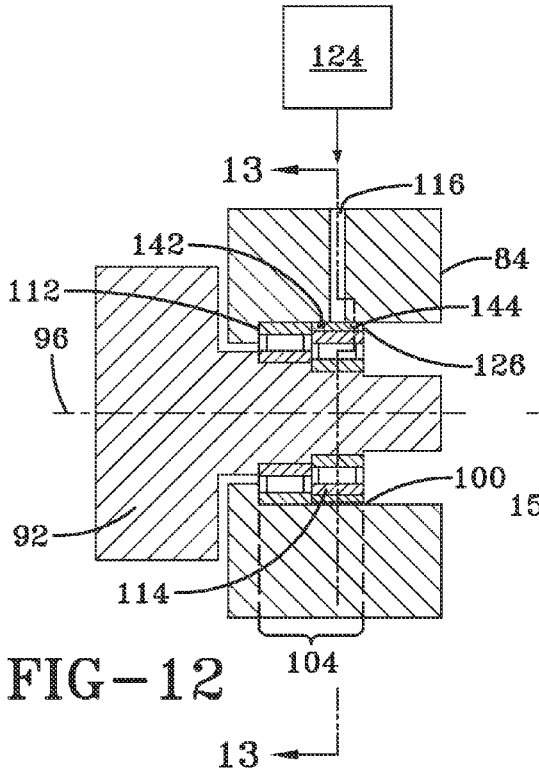
FIG. 12 shows an enlarged partial side view of a screw compressor with an exemplary side-by-side bearing arrangement.
Figure 13:
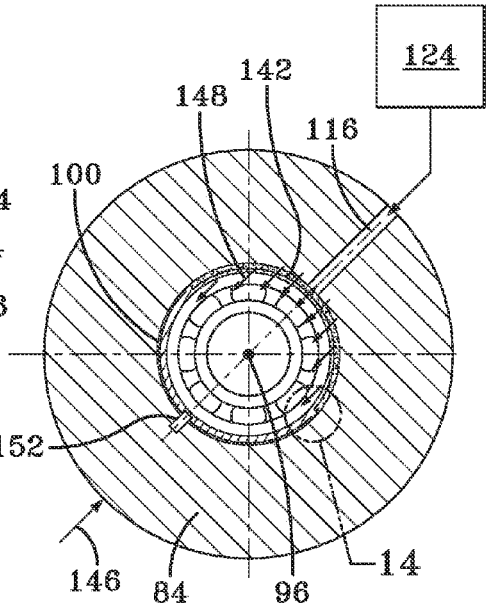
FIG. 13 shows a cross-section taken along line 13-13 of FIG. 12 of an exemplary bearing arrangement.
Figure 14:
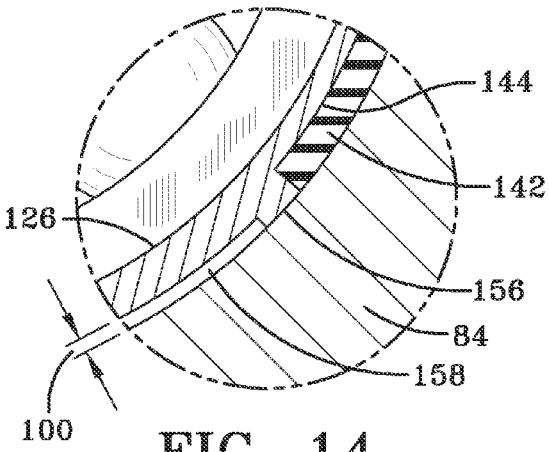
FIG. 14 shows an enlarged partial side view of an exemplary screw compressor housing/bearing interface taken from region 14 of FIG. 13.

As further shown in FIG. 12, the outer diameter of bushing 126 is configured with a predetermined spacing or clearance 100 relative to the inner diameter of the housing 84 such that bushing 126, as well as second bearing 114, is permitted to "float" within housing 84 as a result of diametrical clearances provided by clearance 100. Due to the press fit between bushing 126 and second bearing 114, bushing 126 and second bearing 114 do not move relative to one another. As a result of clearance 100 due to surface feature 158 formed in bushing 126 relative to the inner diameter of housing 84, bushing 126 and second bearing 114 are permitted a small amount of free movement together in a direction transverse to axis 96, such as along plane 136 (FIG. 15) that is perpendicular to plane 96. Clearance 100 is of sufficient magnitude such that under a condition in which it is desirable for second bearing 114 to react or counteract at least a portion of the generated rotor forces, such as generated by gas force 146 (FIG. 13), a predetermined magnitude of pressurized fluid from pressurized fluid source 124 results in a distributed force 148 applied against bushing 126 along piston axis 134 that results in a corresponding movement of the collective bushing 126 and second bearing 114 relative to the inner diameter of housing 84 along plane 136 (FIG. 15), such movement resulting in the desired reactive or counteracting forces applied to second bearing 114.

Figure 1:
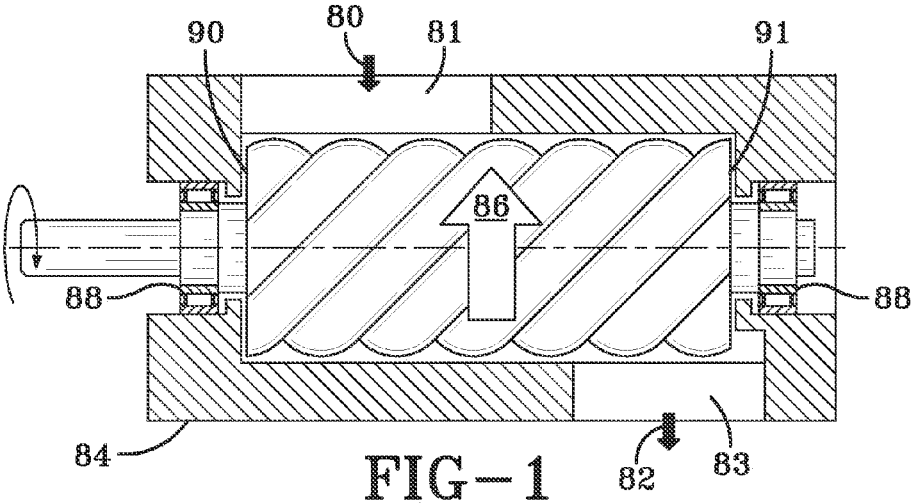
FIG-1 PRIOR ART
FIG. 1 shows a side view of a conventional screw compressor arrangement and the forces generated during operation.
Figure 2:
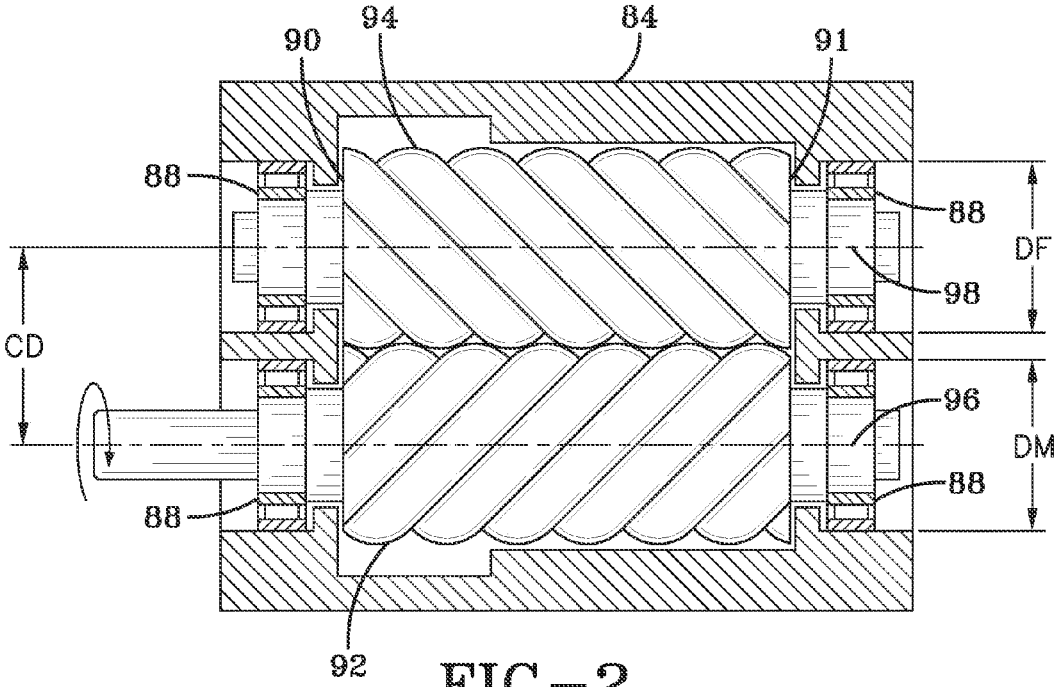
FIG-2 PRIOR ART
FIG. 2 shows a top view of a conventional screw compressor arrangement.
Figure 4:
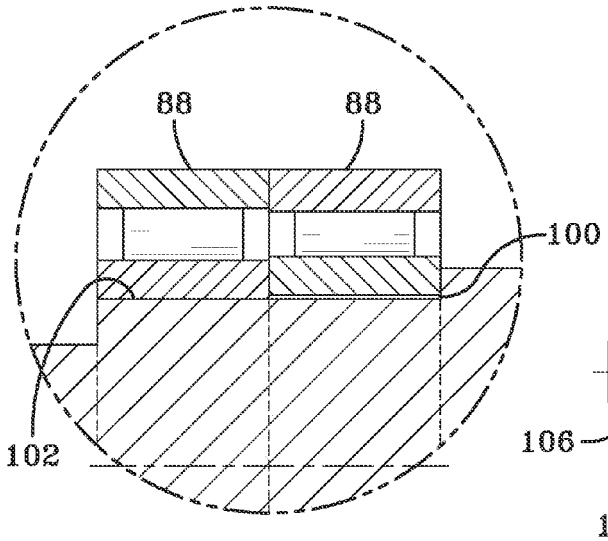
FIG–4 PRIOR ART
FIG. 4 shows an enlarged, partial view taken from region 5 of FIG. 3.
Figure 3:
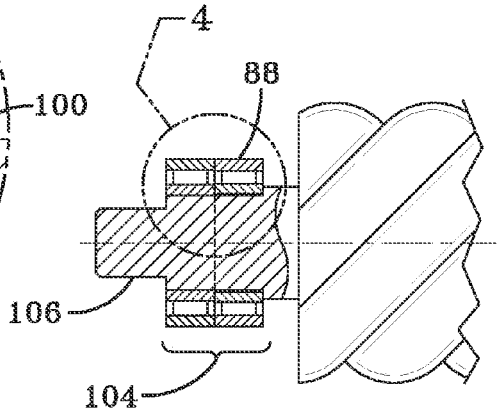
FIG–3 PRIOR ART
FIG. 3 shows a partial side view of an end of a rotor with a conventional side-by-side arrangement of bearings.
Figure 5:
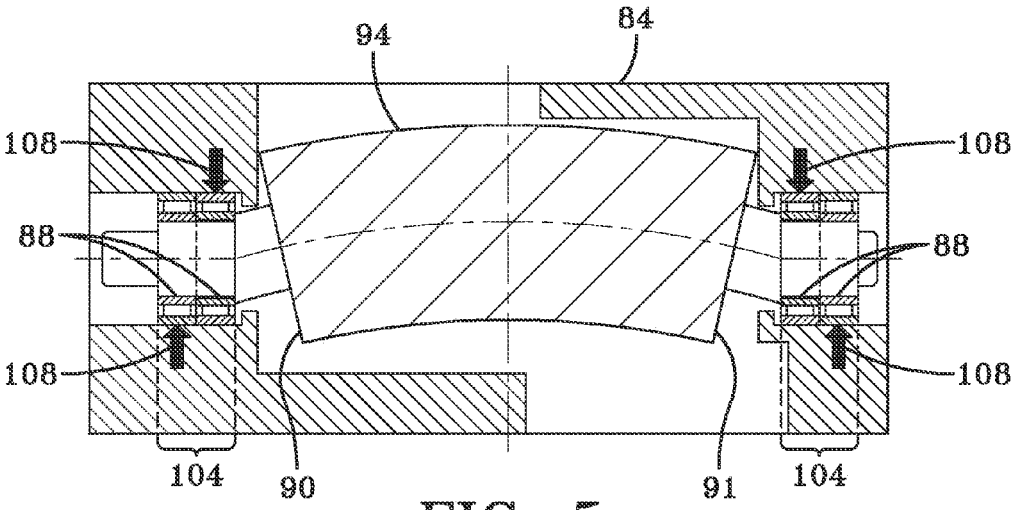
FIG–5 PRIOR ART
FIG. 5 shows a side view of deformation of a rotor of a screw compressor arrangement with a conventional side-by-side arrangement of bearings.

As further shown collectively in FIGS. 12-15, bushing 126 also includes a surface feature 158, such as a recess, corresponding to clearance 100 that is positioned opposite resilient material 142. Surface feature 158 receives pressurized refrigerant gas discharged from outlet 83 (FIG. 1) of housing 84. Separating resilient material 142 (which is received in surface feature 144) and surface feature 158 is another surface feature 156, such as a protrusion that abuts housing 84. In one embodiment, in which pressurized fluid source 124 is not provided by the gas flowing through the compressor or oil used in the compressor, the seal between resilient material 142 and housing 84 should generally be fluid tight. In another embodiment, in which pressurized fluid source 124 is provided by the gas flowing through the compressor or oil used in the compressor, the seal between resilient material 142 and housing 84 can be substantially fluid tight. That is, under such circumstances, a small amount of pressurized fluid leakage between the resilient material and housing would be permissible, so long as a sufficient pressure level can be maintained for proper operation of the bearings.

In an alternate embodiment, the resilient material 142, such as an O-ring may be secured to surface features 158 formed in housing 84. In one construction, a groove is machined in housing 84 to receive the O-ring. Such an arrangement would form a substantially fluid tight seal between housing 84 and the outer race of second bearing 114 for the pressurized fluid (e.g., gas or oil). In one embodiment, in which pressurized fluid source 124 is not provided by the gas flowing through the compressor or oil used in the compressor, the seal between resilient material 142 and housing 84 should generally be fluid tight. In another embodiment, in which pressurized fluid source 124 is provided by the gas flowing through the compressor or oil used in the compressor, the seal between resilient material 142 and housing 84 can be substantially fluid tight. That is, under such circumstances, a small amount of pressurized fluid leakage between the resilient material and housing would be permissible, so long as a sufficient pressure level can be maintained for proper operation of the bearings. In this arrangement, a separate bushing between second bearing 114 and housing 84 is not needed.

Figure 16:
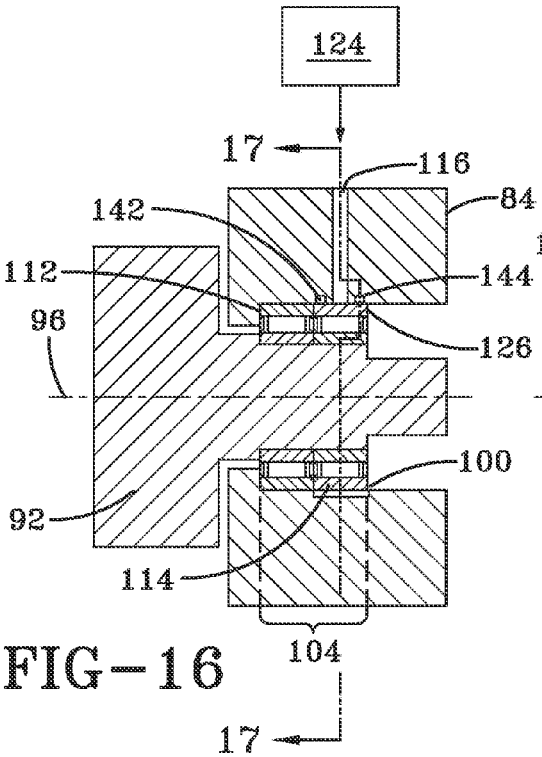
FIG. 16 shows an enlarged partial side view of a screw compressor with an exemplary side-by-side bearing arrangement.
Figure 17:
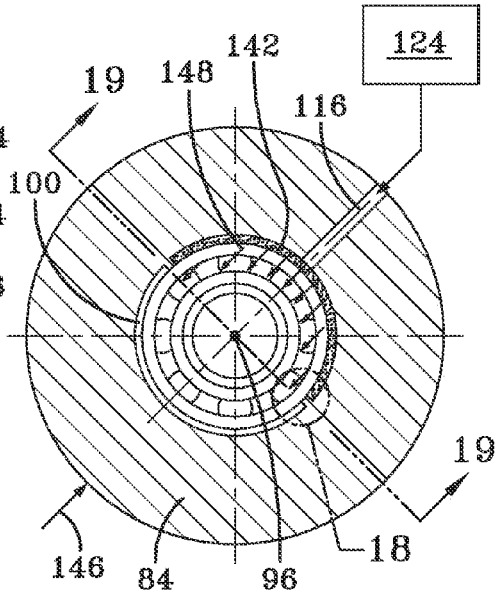
FIG. 17 shows a cross-section taken along line 17-17 of FIG. 16 of an exemplary bearing arrangement.
Figure 18:
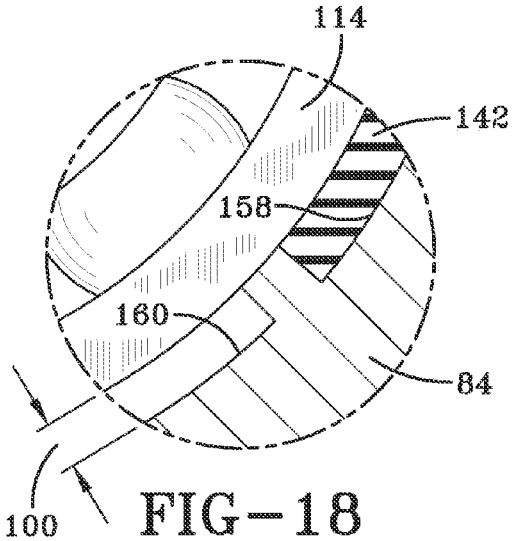
FIG. 18 shows an enlarged partial side view of an exemplary screw compressor housing/bearing interface taken from region 18 of FIG. 17.
Figure 19:
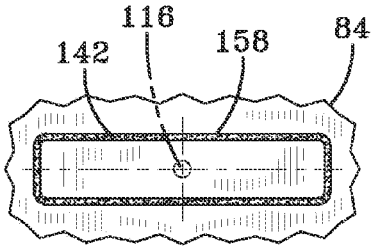
FIG. 19 shows a partial view taken along line 19-19 of FIG. 17 of a portion of the housing for supporting a bearing.

As further shown in FIG. 16, the inner diameter of housing 84 is configured with a predetermined spacing or clearance 100 relative to the outer diameter of second bearing 114, permitting second bearing 114 to "float" within housing 84 as a result of diametrical clearances provided by clearance 100. As a result of clearance 100 due to surface feature 160 formed in the inner diameter of housing 84, second bearing 114 is permitted a small amount of free movement in a direction transverse to axis 96, such as along plane 136 (FIG. 15) that is perpendicular to plane 96. Clearance 100 is of sufficient magnitude such that under a condition in which it is desirable for second bearing 114 to react or counteract at least a portion of the generated rotor forces, such as generated by gas force 146, a predetermined magnitude of pressurized fluid from pressurized fluid source 124 results in a distributed force 146 (FIG. 17) applied against second bearing 114 along piston axis 134 that results in a corresponding movement of the second bearing 114 relative to the inner diameter of housing 84 along plane 136 (FIG. 15), such movement resulting in the desired reactive or counteracting forces applied to second bearing 114.

For purposes of the present disclosure, the term bearing is not intended to be limited to the outer race of the bearing, but can also include a bushing that surrounds the bearing. That is, the term bearing is intended to encompass embodiments in which the conduit is in fluid communication with at least one bearing and embodiments in which the conduit is in fluid communication with at least one bushing surrounding respective bearing(s) that can be positioned between the bearing and the housing.

As shown collectively in FIGS. 16-19, an exemplary embodiment of the bearing arrangement, such as side-by-side 104 positioned first bearing 112 and second bearing 114 includes resilient material 142, such as an O-ring that is configured to be received by surface features 158 formed in housing 84 and forming a substantially fluid tight seal between housing 84, conduit 116 and second bearing 114. As further shown in FIGS. 16-19, surface features 158 formed in housing 84 partially surrounds second bearing 114, e.g., up to 180 degrees. Similarly, as previously discussed and further shown in FIGS. 16-19, pressurized gas or oil contained in conduit 116 formed in housing 84 results in the application of a distributed load or distributed force 148 to second bearing 114 in a direction that is opposite that of gas force 146 generated during operation of the rotors 92, 94 (rotor 92 shown in FIG. 16) of the screw compressor.

As further shown in FIG. 16, the outer diameter of second bearing 114 is configured with a predetermined spacing or predetermined clearance 100 relative to the inner diameter of housing 84 such that second bearing 114, is permitted to "float" within housing 84 as a result of diametrical clearances, such as from normal manufacturing tolerancing dimensions.

Figure 20A:
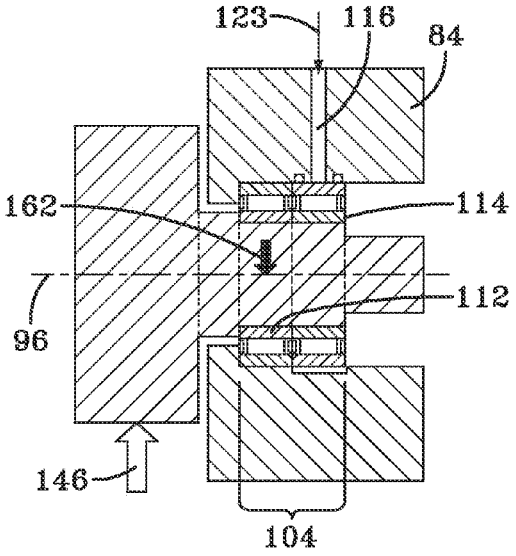
FIGS. 20A-20D show different loading scenarios of the exemplary screw compressor bearing arrangement.
Figure 20B:
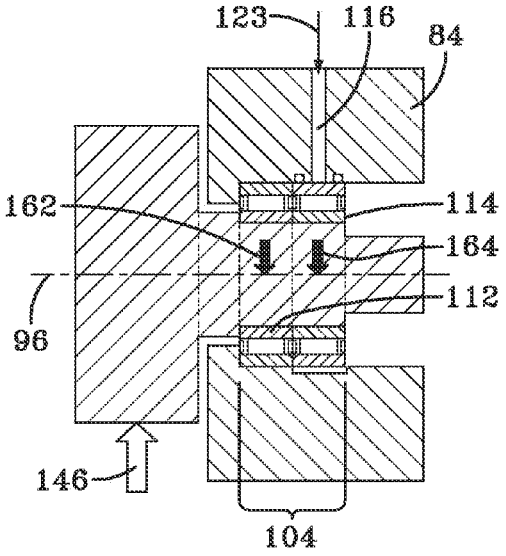
Figure 20C:
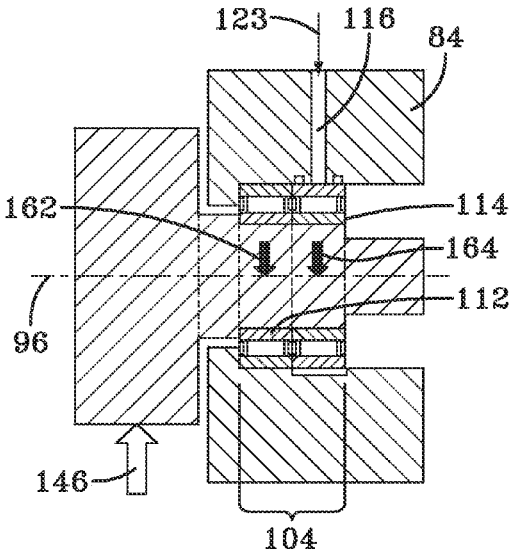
Figure 20D:
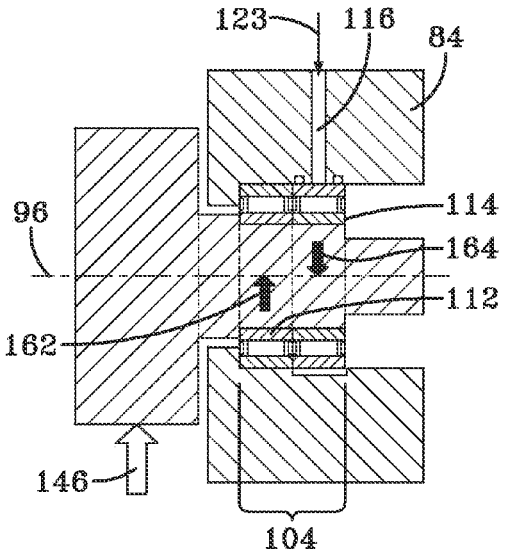

FIGS. 20A-20D show different loading/operating configurations of the side-by-side 104 bearing arrangement of the present disclosure. For example, in FIG. 20A, if no pressurized fluid 123 is provided to second bearing 114, the first bearing 112 reacts or counteracts, using first bearing force 162, all of the generated rotor forces, such as by gas force 146. In FIG. 20B, sufficient pressurized fluid 123 is provided to second bearing 114 such that first bearing 112 and second bearing 114 substantially equally react or counteract by using corresponding first bearing force 162 and second bearing force 164, the generated rotor forces. In FIG. 20C, pressurized fluid 123 is provided to second bearing 114 such that first bearing 112 and second bearing 114 do not equally react or counteract by using corresponding first bearing force 162 and second bearing force 164, the generated rotor forces. In FIG. 20D, pressurized fluid 123 is provided to second bearing 114 such that second bearing 114 primarily reacts or counteracts by using second bearing force 164 and second bearing force 164, substantially all of the generated rotor forces, with an additional first bearing force 162 applied to first bearing 112 in order to prevent "skidding." Skidding occurs when there is insufficient force to maintain the rollers in the bearing in rolling contact with the bearing races. That is, in addition to the bearing rollers being maintained in rolling contact with the bearing races, there is also a sliding motion between the bearing rollers and the bearing races which is detrimental to service life.

Figure 24:
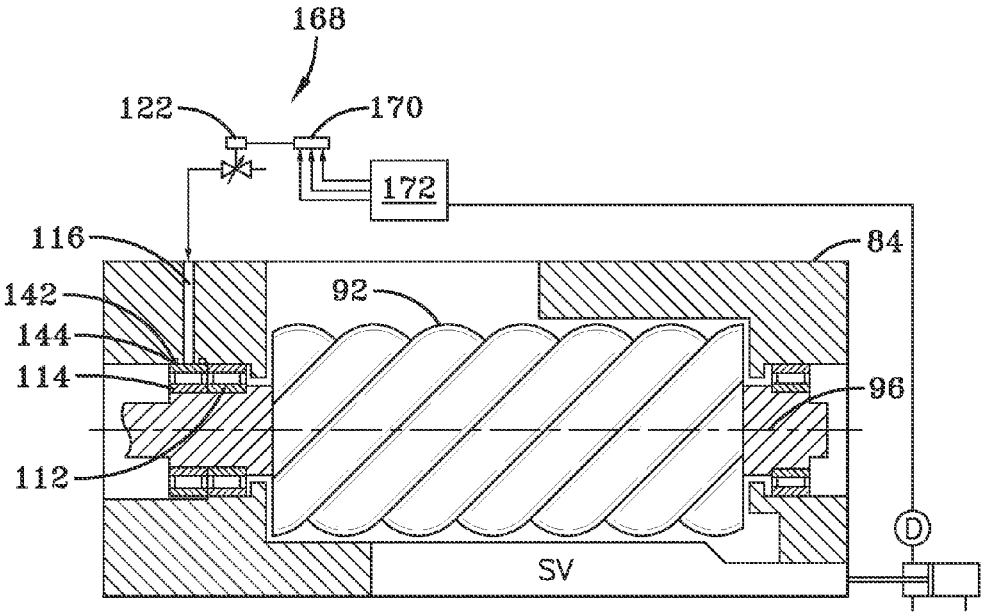
FIG. 24 shows a schematic side view of an exemplary embodiment of a screw compressor.

As shown in FIG. 24, the pressure of pressurized fluid supplied through conduit 116 to second bearing 114 may be regulated by a flow control device 168, such as by an adjustable valve 122 that is operatively connected to a controller 170. Controller 170 regulates the amount of pressurized fluid supplied to second bearing 114 as a function of various operating parameters 172 of the screw compressor, such as, but not limited to the magnitude of the suction pressure, the magnitude of the discharge pressure, as well as the position of slide valve (SV) relative to the housing. As a result of this control by controller 170, second bearing 114 can support a portion of the operating load forces otherwise supported by first bearing 112.

Figure 25:
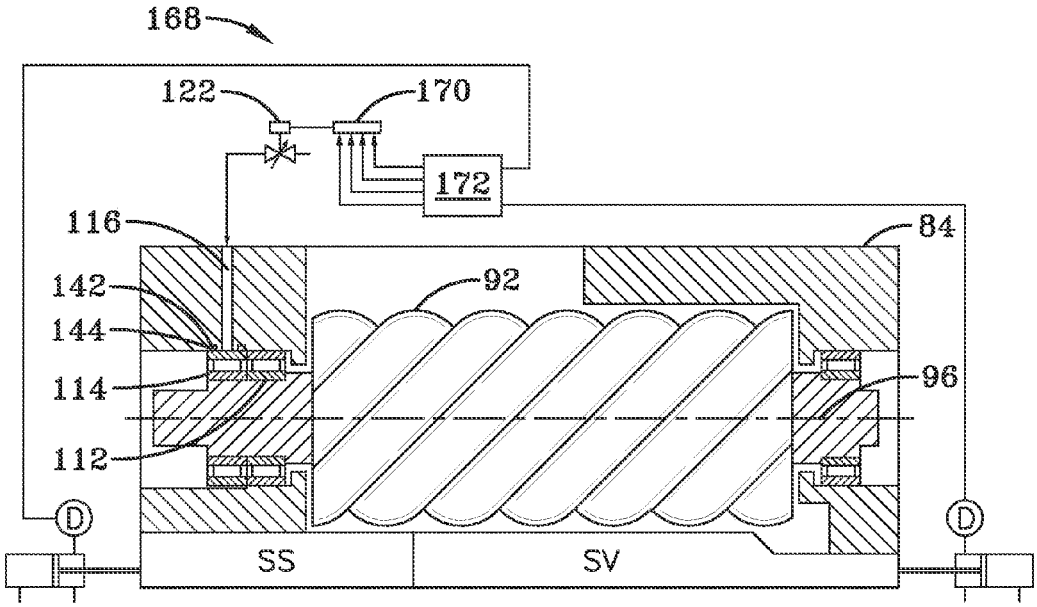
FIG. 25 shows a schematic side view of an exemplary embodiment of a screw compressor.

FIG. 25 shows a screw compressor operating with a variable volume index system (Vi). A variable volume index system (Vi) primarily differs from a screw compressor operating with a fixed volume index due to the addition of an adjustable slide stop (SS). The slide stop positions slide valve (SV) so that the Vi of the compressor matches the system requirements preventing over or under compression conditions. The amount of pressurized fluid supplied through conduit 116 to second bearing 114 may be regulated by a flow control device 168, such as controller 170 operatively connected to an adjustable valve 122. Controller 170 regulates the amount of pressurized fluid supplied to second bearing 114 as a function of various operating parameters 172 of the screw compressor, such as, but not limited to the magnitude of the suction pressure, the magnitude of the discharge pressure, the position of the slide valve (SV), as well as the position of the slide stop (SS) relative to housing 84, controller 170 operating to regulate flow control device 168 in a known manner.

Figure 26:
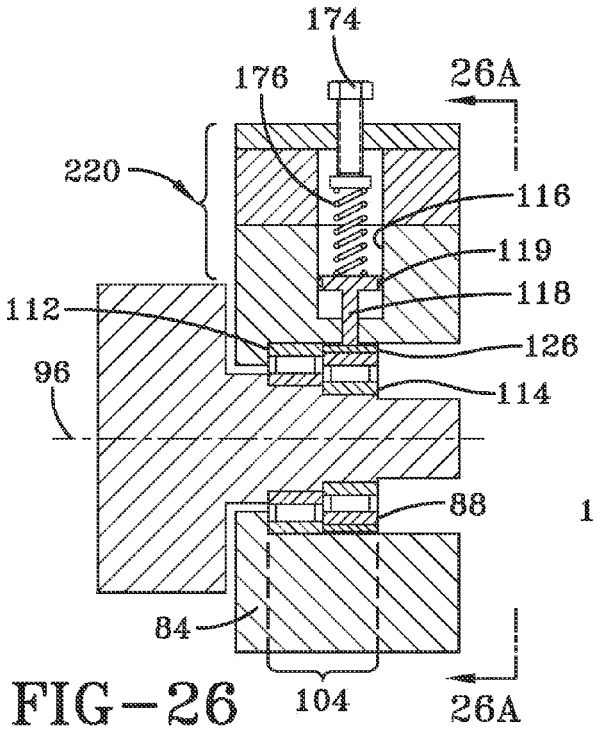
FIG. 26 shows an enlarged partial side view of a screw compressor with an exemplary side-by-side bearing arrangement.
Figure 26A:
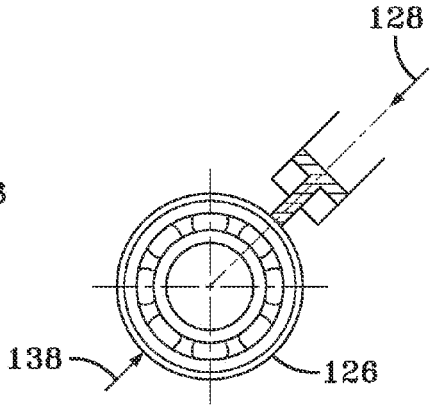
FIG. 26A shows a cross-section taken along line 26-26 of FIG. 26 of an exemplary bearing arrangement.
Figure 27:
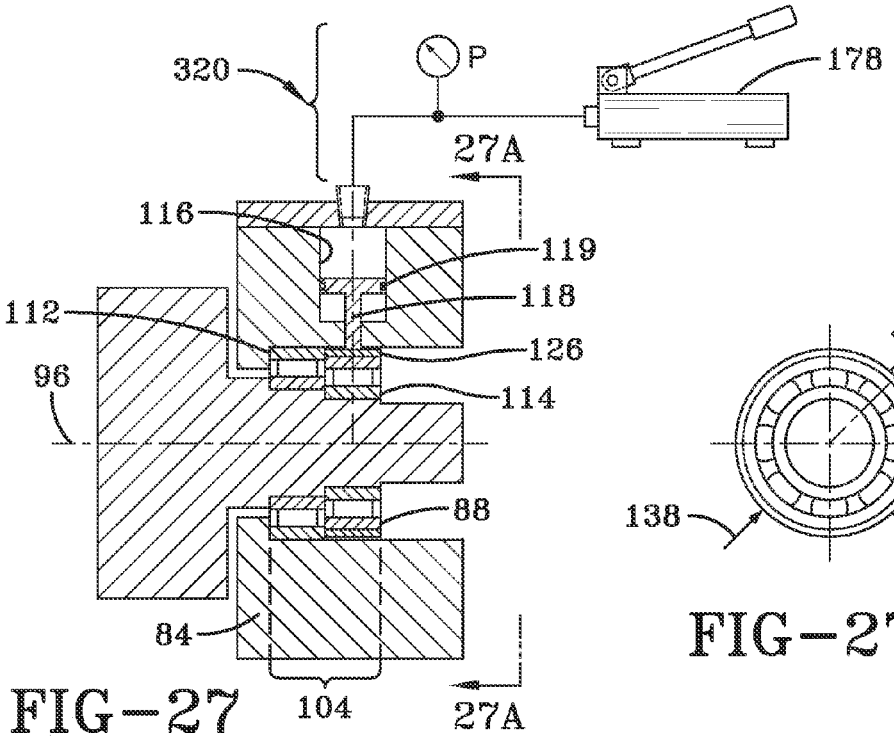
FIG. 27 shows an enlarged partial side view of a screw compressor with an exemplary side-by-side bearing arrangement.
Figure 27A:
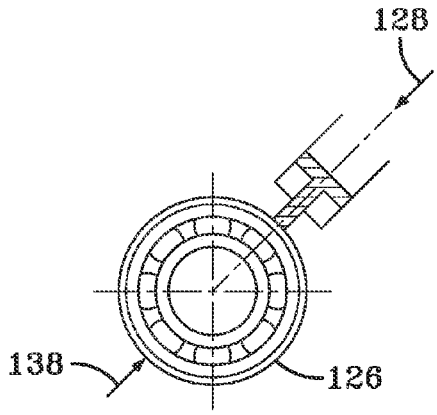
FIG. 27A shows a cross-section taken along line 27-27 of FIG. 27 of an exemplary bearing arrangement.

FIGS. 26 and 26A collectively show an exemplary embodiment of a screw compressor having a side-by-side 104 bearing arrangement of first bearing 112 and second bearing 114 such as shown in FIGS. 9-11 and previously discussed in the present disclosure. Screw compressor housing 84 includes conduit 116 formed in housing 84 within which piston 118 is selectably movable, such as by a force generating source 220, such as by an adjustment fastener 174 and piston force 128 generated by a spring 176 instead of a pressurized gas or oil (fluid) source, such as previously discussed in FIGS. 9-11. FIGS. 27 and 27A collectively show an exemplary embodiment of a screw compressor having a side-by-side 104 bearing arrangement similar to FIGS. 9-11 as previously discussed. Screw compressor housing 84 includes a conduit 116 formed in housing 84 within which piston 118 is selectably movable, such as by a force generating source 320, in which pressurized gas or oil (fluid) is generated by a hand pump 178, such as previously discussed in FIGS. 9-11.

Figure 28:
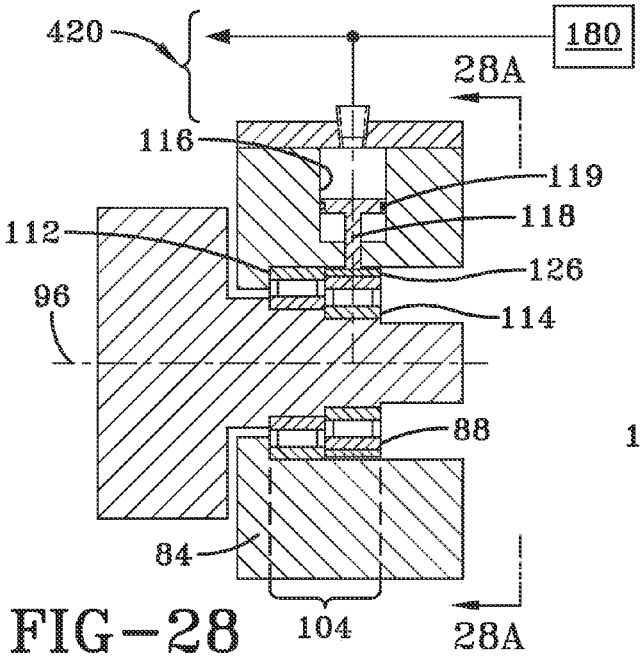
FIG. 28 shows an enlarged partial side view of a screw compressor with an exemplary side-by-side bearing arrangement.
Figure 28A:
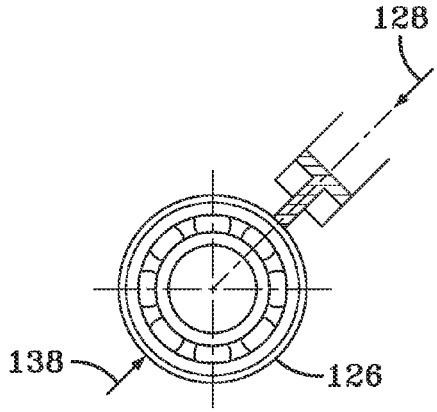
FIG. 28A shows a cross-section taken along line 28-28 of FIG. 28 of an exemplary bearing arrangement.

FIGS. 28 and 28A collectively show an exemplary embodiment of a screw compressor having a side-by-side 104 bearing arrangement similar to FIGS. 9-11 as previously discussed. Screw compressor housing 84 includes conduit 116 formed in housing 84 within which piston 118 having a peripheral seal 119 is selectably movable, such as by a force generating source 420, in which pressurized gas or oil (fluid) is generated by a central air pressure system 180, such as previously discussed in FIGS. 9-11.

Figure 29:
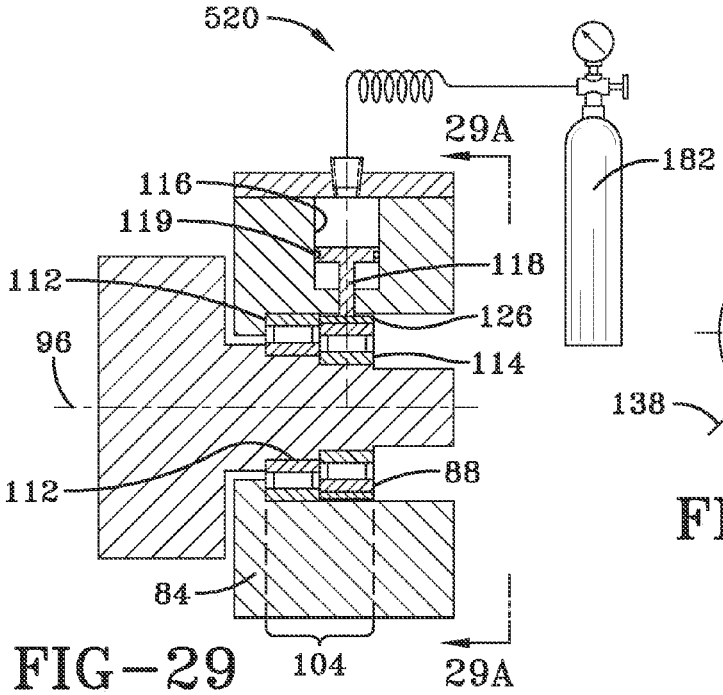
FIG. 29 shows an enlarged partial side view of a screw compressor with an exemplary side-by-side bearing arrangement.
Figure 29A:
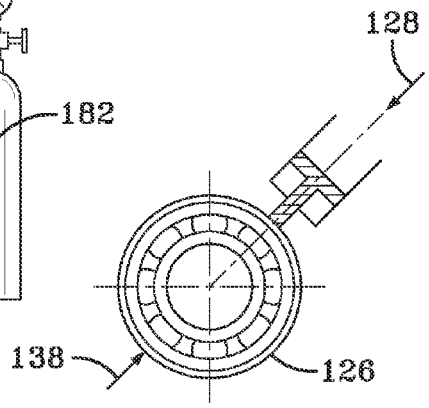
FIG. 29A shows a cross-section taken along line 29-29 of FIG. 29 of an exemplary bearing arrangement.

FIGS. 29 and 29A collectively show an exemplary embodiment of a screw compressor 38 having a side-by-side 104 bearing arrangement similar to FIGS. 9-11 as previously discussed. Screw compressor housing 84 includes conduit 116 formed in housing 84 within which piston 118 is selectably movable, such as by a force generating source 520, in which pressurized gas or oil (fluid) is provided by a pressurized nitrogen bottle 182, or other suitable pressurized gas, such as previously discussed in FIGS. 9-11.

Figure 30:
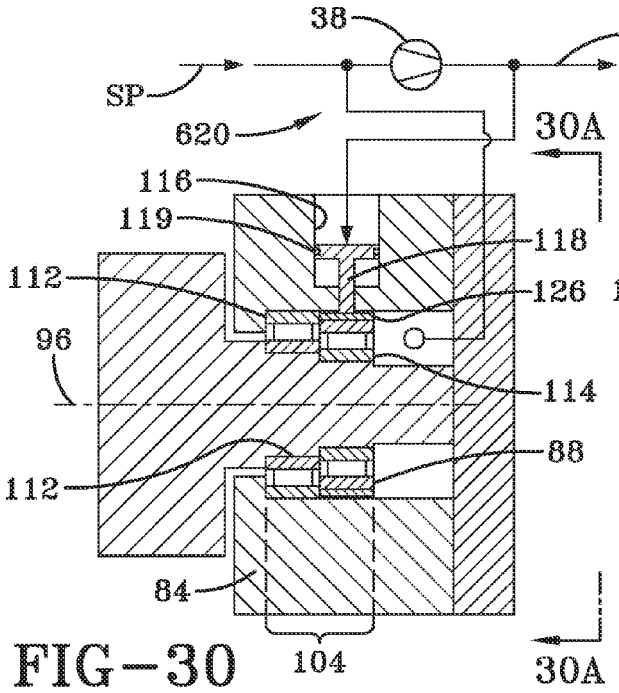
FIG. 30 shows an enlarged partial side view of a screw compressor with an exemplary side-by-side bearing arrangement.
Figure 30A:
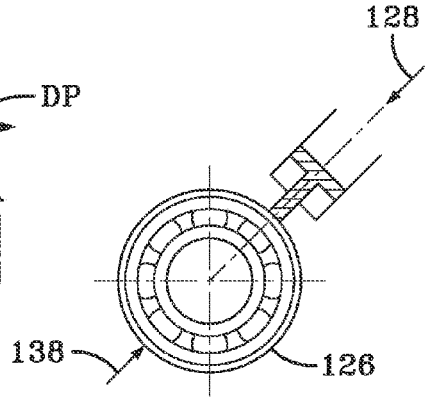
FIG. 30A shows a cross-section taken along line 30-30 of FIG. 30 of an exemplary bearing arrangement.
Figure 30B:
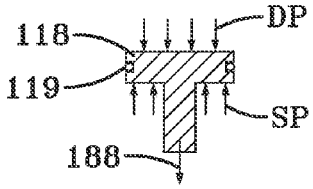
FIG. 30B shows a schematic force applied to a piston of FIG. 30.

FIGS. 30 and 30A collectively show an exemplary embodiment of a screw compressor having a side-by-side 104 bearing arrangement similar to FIGS. 9-11 as previously discussed. Screw compressor housing 84 includes conduit 116 formed in housing 84 within which piston 118 is selectably movable, such as by a force generating source 620, in which pressurized gas, such as a discharge pressure ("DP") from a compressor 38. As further shown in FIG. 30, a suction pressure ("SP") or suction inlet pressure generated by compressor 38 is applied to the bearings. As further shown in FIG. 30B, a schematic diagram of the forces applied to piston 118 provide a resultant piston force 188. The resultant piston force ("Force") (188) is calculated by the product of the area ("A") of piston 118 and the difference between the discharge pressure (DP) and the suction pressure (SP) as identified in equation 2:

$$\text{Force}=A*(\text{DP}-\text{SP}) \quad [2]$$

Figure 31:
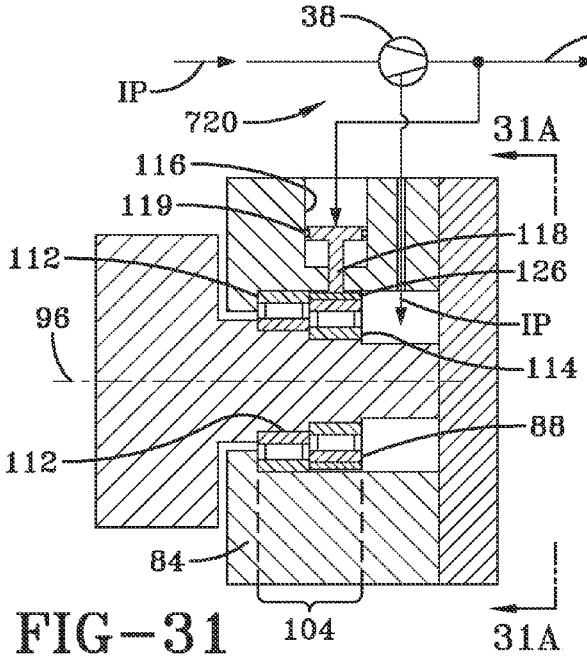
FIG. 31 shows an enlarged partial side view of a screw compressor with an exemplary side-by-side bearing arrangement.
Figure 31A:
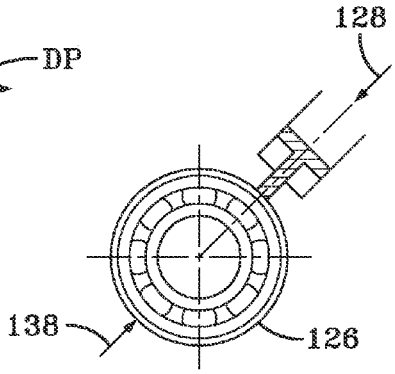
FIG. 31A shows a cross-section taken along line 1 of FIG. 31 of an exemplary bearing arrangement.
Figure 31B:
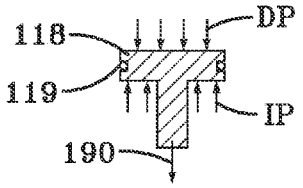
FIG. 31B shows a schematic force applied to a piston of FIG. 31.

FIGS. 31 and 31A collectively show an exemplary embodiment of a screw compressor 38 having a side-by-side 104 bearing arrangement similar to FIGS. 30 and 30A. Screw compressor housing 84 includes conduit 116 formed in housing 84 within which piston 118 is selectably movable, such as by a force generating source 720, in which pressurized gas, such as a discharge pressure (DP) from compressor 38. As further shown in FIG. 31, an intermediate pressure ("IP") between suction pressure (SP) and the discharge pressure (DP) generated by compressor 38 is applied to the bearings. As further shown in FIG. 31B, a schematic diagram of the forces applied to piston 118 provide a resultant piston force 190. The resultant piston force ("Force") (190) is calculated by the product of the area (A) of piston 118 and the difference between the discharge pressure (DP) and the intermediate pressure (IP).

$$\text{Force}=A*(\text{DP}-\text{IP}) \quad [3]$$

Figure 32:
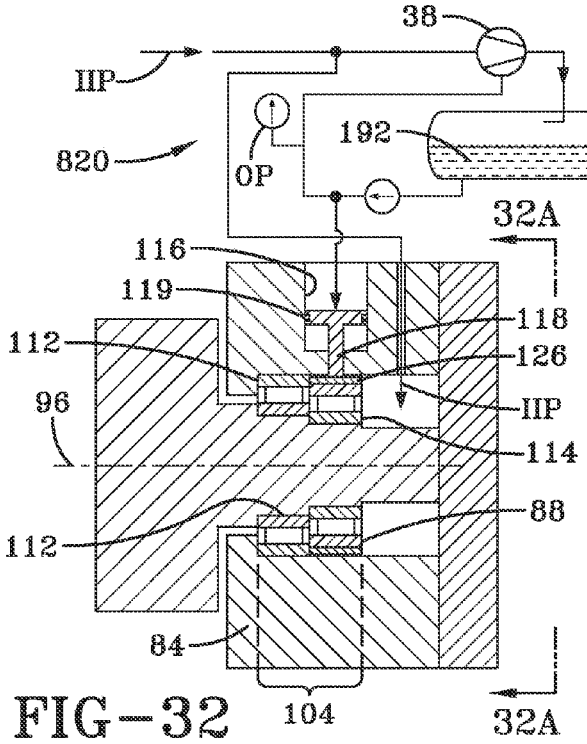
FIG. 32 shows an enlarged partial side view of a screw compressor with an exemplary side-by-side bearing arrangement.
Figure 32A:
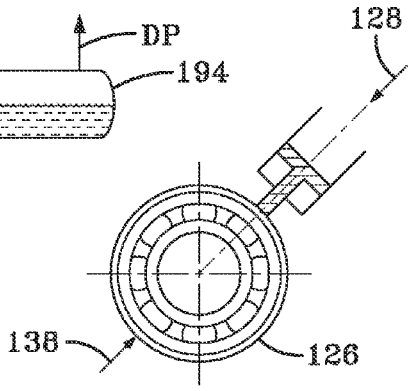
FIG. 32A shows a cross-section taken along line 32-32 of FIG. 32 of an exemplary bearing arrangement.
Figure 32B:
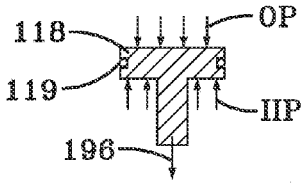
FIG. 32B shows a schematic force applied to a piston of FIG. 32.

FIGS. 32 and 32A collectively show an exemplary embodiment of a screw compressor 38 having a side-by-side 104 bearing arrangement similar to FIGS. 30 and 30A. Screw compressor housing 84 includes conduit 116 formed in housing 84 within which piston 118 is selectably movable, such as by a force generating source 820, in which pressurized fluid, such as pressurized oil ("OP") (192) from an oil separator 194 or oil tank receiving refrigerant gas at discharge pressure (DP) from compressor 38. As further shown in FIG. 32, an inlet pressure (IIP) or suction pressure upstream of compressor 38 is applied to the bearings. As further shown in FIG. 32B, a schematic diagram of the forces applied to piston 118 provide a resultant piston force 196. The resultant piston force ("Force") (192) is calculated by the product of the area (A) of piston 118 and the difference between the oil pressure (OP) and the inlet pressure ("IIP").

$$\text{Force}=A*(\text{OP}-\text{IIP}) \quad [4]$$

It is to be understood that the pressurized fluid may be a pressurized gas such as a pressurized refrigerant from a discharge outlet of the compressor. Since the bearing cavity is typically connected to the inlet side or to the compression chamber in close proximity of the compressor, the difference in pressure between the discharge outlet and the bearing cavity thereby provides a pressure difference. When the pressurized fluid is a pressurized refrigerant, an amount of fluid leakage of the seal between the housing and the bearing and/or bushing is permitted, so long as the desired pressure can be maintained. In another embodiment, the pressurized fluid may be a pressurized oil if the compressor operates with oil injected into the compressor. Similarly, when the pressurized fluid is a pressurized oil, an amount of fluid leakage of the seal between the housing and the bearing and/or bushing is permitted, so long as the desired pressure can be maintained. In one embodiment, pressurized fluid may be provided from a separate pressurized fluid loop. A controller, such as previously described above can be utilized to selectably regulate the pressurized fluid.

It is to be understood that the bearing arrangement of the present disclosure is not limited to compressors utilized in HVAC&R applications. That is, the present disclosure includes a compressor for compressing gas in non-HVAC&R applications, such as natural gas pump stations or other process gas applications, such as an air compressor.

It is to be further understood that the present disclosure includes compression systems including a pair of shafts having substantially parallel rotational axes, in which the rotating shafts are configured to compress matter passing between them. For example, applications include but are not limited to screw pumps, Roots blowers, paper mills, fabric weaving machinery, and steel plate rolling. That is, the matter compressed between the rotating shafts may be a gas, liquid or solid or combination thereof. The axes of the pair of shafts are in sufficiently close proximity to one another to be suitable for the particular application.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A system, comprising:

a housing;

a first shaft rotatable with respect to the housing, disposed within the housing, and having a first rotor axis extending axially within the first shaft;

a first bearing disposed circumferentially about the first shaft at a first axial position along the first rotor axis;

a second bearing disposed circumferentially about the first shaft at a second axial position along the first rotor axis, wherein the second axial position is adjacent to the first axial position; and a force generating source configured to selectively exert a first force in a radial direction on a first outer surface of the first bearing based on a desired share, between the first and second bearings, of an operating load of the system, wherein the first bearing is configured to respond to the first force by moving radially relative to the second bearing.

2. The system of claim 1, wherein the force generating source comprises an actuator driven by an electric motor.

3. The system of claim 1, wherein the force generating source utilizes a pressurized fluid to exert the first force.

4. The system of claim 1, comprising:

a second shaft rotatable with respect to the housing, disposed within the housing, and having a second rotor axis extending axially within the second shaft;

a third bearing disposed circumferentially about the second shaft at a third axial position along the second rotor axis; and a fourth bearing disposed circumferentially about the second shaft at a fourth axial position along the second rotor axis, wherein the fourth axial position is adjacent to the third axial position, and wherein the force generating source, or an additional force generating source, is configured to selectively exert a second force in the radial direction on a third outer surface of the third bearing based on a desired share, between the third and fourth bearings, of the operating load of the system, wherein the third bearing is configured to respond to the second force by moving radially relative to the fourth bearing.

5. The system of claim 1, comprising a compressor having the housing, the shaft, and the first and second bearings.

6. The system of claim 5, wherein the compressor comprises a screw compressor, a reciprocating compressor, a scroll compressor, or a rotary compressor.

7. The system of claim 5, comprising a controller configured to determine a magnitude of the first force in the radial direction based at least in part on an operating parameter of the compressor, and to control the force generating source such that the force generating source exerts the magnitude of the first force in the radial direction.

8. The system of claim 1, comprising:

a passageway extending radially through the housing and configured to enable exertion of the first force by the force generating source; and an O-ring extending circumferentially about the first bearing proximate to the passageway and between the first outer surface of the first bearing and an inner surface of the housing.

9. The system of claim 8, wherein the first bearing, the housing, or both comprise a groove or a channel configured to receive the O-ring therein.

10. The system of claim 8, wherein the O-ring extends less than 360degrees circumferentially about the first bearing, and wherein the system comprises a space between the first bearing and the inner surface of the housing opposite the O-ring.

11. The system of claim 1, wherein the system comprises an HVAC system.

12. The system of claim 1, wherein the force generating source comprises a selectively moveable piston, a pressurized fluid source, a valve adjustable by pressurized fluid from a pressurized fluid source, a fastener adjustable by a spring, a hand pump, a central air pressure system, a pressurized nitrogen bottle, a discharge pressure from the compressor or another compressor, an intermediate pressure from the compressor or the other compressor, a pressurized oil from an oil separator, or a combination thereof.

13. A control system of a compressor, comprising:

a controller;

a sensor communicatively coupled with the controller, wherein the sensor is configured to detect an operating parameter of the compressor, and wherein the sensor is configured to communicate data indicative of the operating parameter to the controller; and a force generating source configured to exert a radial force on a first bearing element of a pair of bearing elements of the compressor, wherein the controller is configured to determine a first magnitude of the radial force based on the data indicative of the operating parameter, and wherein the controller is configured to instruct the force generating source to exert the first magnitude of the radial force on the first bearing element, such that the first bearing element is configured to move radially relative to a second bearing element of the pair of bearing elements in response to the first magnitude of the radial force.

14. The control system of claim 13, wherein the operating parameter comprises a suction pressure magnitude, a discharge pressure magnitude, or a position of a slide stop of the compressor.

15. The control system of claim 13, wherein the force generating source comprises a pressurized fluid and a flow control device communicatively coupled with the controller, and wherein the controller is configured to control the flow control device to enable the first magnitude of the radial force.

16. The control system of claim 13, wherein the force generating source comprises a piston, a spring, or an electrically driven motor.

17. A compressor, comprising:

a housing;

a first rotor rotatable with respect to the housing and extending along a first rotor axis, wherein the first rotor comprises a first rotor body extending along the first rotor axis, a first rotor end near an inlet of the compressor, and a second rotor end near an outlet of the compressor opposite to the inlet of the compressor;

a first bearing disposed circumferentially about the first rotor body at the first or the second rotor end;

a second bearing disposed circumferentially about the first rotor body at the first or the second rotor end, and adjacent to the first bearing;

a controller configured to determine, based at least in part on a desired share between the first and second bearings of a compressor operating load, a first magnitude of a radial force to be exerted on a first outer surface of the first bearing; and a force generating source configured to, upon instruction by the controller, selectively exert the first magnitude of the radial force, wherein the compressor is configured to route the first magnitude of the radial force on the first outer surface of the first bearing, and wherein the first bearing is configured to move radially relative to the second bearing in response to the first magnitude of the radial force.

18. The compressor of claim 17, wherein a sensor communicatively coupled with the controller is configured to detect the compressor operating load, or an operating parameter indicative thereof, and wherein the sensor is configured to communicate data indicative of the compressor operating load, or the operating parameter thereof, to the controller.

19. The compressor of claim 18, wherein the controller determines the first magnitude of the radial force based at least in part on the data indicative of the compressor operating load, or the operating parameter thereof.

20. The compressor of claim 17, comprising:

a second rotor rotatable with respect to the housing and extending along a second rotor axis, wherein the second rotor comprises a second rotor body extending along the second rotor axis, a third rotor end near the inlet of the compressor, and a fourth rotor end near the outlet of the compressor opposite to the inlet of the compressor;

a third bearing disposed circumferentially about the second rotor body at the third or the fourth rotor end; and a fourth bearing disposed circumferentially about the second rotor body at the third or the fourth rotor end, and adjacent to the third bearing;

wherein the controller is configured to determine, based at least in part on a desired share between the third and fourth bearings of the compressor operating load, a second magnitude of an additional radial force to be exerted on a third outer surface of the third bearing, wherein the force generating source, or an additional force generating source, is configured to, upon instruction by the controller, selectively exert the second magnitude of the additional radial force, wherein the compressor is configured to route the second magnitude of the additional radial force on the third outer surface of the third bearing, and wherein the third bearing is configured to move radially relative to the fourth bearing in response to the second magnitude of the additional radial force.

21. The compressor of claim 17, wherein the force generating source utilizes a pressurized fluid to selectively exert the first magnitude of the radial force.

22. The compressor of claim 17, wherein the compressor comprises a screw compressor, a reciprocating compressor, a scroll compressor, or a rotary compressor.

23. The compressor of claim 17, comprising a passageway extending radially through the stator housing and configured to enable exertion of the first magnitude of the radial force by the force generating source.

* * * * *